United States Patent [19]

Eiermann et al.

[11] Patent Number: 4,867,659

[45] Date of Patent: Sep. 19, 1989

[54] PARALLEL-AND EXTERNAL-AXIAL ROTARY PISTON BLOWER OPERATING IN MESHING ENGAGEMENT

[75] Inventors: Dankwart Eiermann, Weissensberg; Wolfgang Sohler, Wangen, both of Fed. Rep. of Germany

[73] Assignee: Wankel GmbH, Berlin, Fed. Rep. of Germany

[21] Appl. No.: 939,282

[22] Filed: Dec. 4, 1986

Related U.S. Application Data

[63] Continuation of Ser. No. 667,952, Nov. 2, 1984, abandoned.

[30] Foreign Application Priority Data

Nov. 7, 1983 [DE] Fed. Rep. of Germany ..... 3340202

[51] Int. Cl.[4] ..... F04C 18/18; F04C 27/00

[52] U.S. Cl. ..... 418/142; 418/151; 418/206

[58] Field of Search ..... 418/179, 75, 191, 206

[56] References Cited

U.S. PATENT DOCUMENTS

| | | | |
|---|---|---|---|
| 77,373 | 4/1868 | Hardy | 418/206 |
| 81,009 | 8/1868 | Roots | 418/206 |
| 103,482 | 5/1870 | McIlwain | 418/206 |
| 110,929 | 1/1871 | McIlwain | 418/206 |
| 143,936 | 10/1873 | Spencer | 418/206 |
| 186,008 | 1/1877 | Holt | 418/206 |
| 593,514 | 11/1897 | Chaudun | 123/239 |
| 597,709 | 1/1898 | Chaudun | 123/238 |
| 626,206 | 5/1899 | Jasper | 123/249 |
| 773,401 | 10/1904 | Leibenguth | 418/206 |
| 799,677 | 9/1905 | Schluter | 418/114 |
| 810,435 | 1/1906 | Reynolds | 123/223 |
| 907,732 | 12/1908 | Bump | 418/40 |
| 1,029,157 | 6/1912 | Ullman | 418/206 |
| 1,086,159 | 2/1914 | Goldberg | 418/206 |
| 1,294,869 | 2/1919 | Bump | 418/206 |
| 1,640,169 | 8/1927 | Witteman | 418/191 |
| 1,846,692 | 2/1932 | Schmidt | 418/206 |
| 1,923,268 | 8/1933 | Jensen | 418/206 |
| 2,161,729 | 6/1939 | Thomson | 418/70 |

(List continued on next page.)

FOREIGN PATENT DOCUMENTS

| | | | |
|---|---|---|---|
| 2021777 | 12/1971 | Fed. Rep. of Germany . | |
| 2061567 | 6/1972 | Fed. Rep. of Germany . | |
| 2243233 | 2/1974 | Fed. Rep. of Germany . | |
| 3232046 | 3/1974 | Fed. Rep. of Germany . | |
| 2302741 | 7/1974 | Fed. Rep. of Germany . | |
| 2534422 | 3/1976 | Fed. Rep. of Germany . | |
| 2524280 | 12/1976 | Fed. Rep. of Germany . | |
| 2852442 | 6/1980 | Fed. Rep. of Germany . | |
| 9765 | of 1843 | United Kingdom | 418/206 |
| 251443 | 5/1926 | United Kingdom | 418/206 |
| 1031991 | 6/1966 | United Kingdom | 418/191 |

*Primary Examiner*—John J. Vrablik

*Attorney, Agent, or Firm*—Becker & Becker, Inc.

[57] ABSTRACT

Rotary pistons on shafts connected therewith counter-rotate in a blower machine casing having casing inner cylindrical surfaces and having an inlet and an outlet in the region of intersections of these casing inner cylindrical surfaces, the cross section of the inlet is approximately 1.35 times the cross section of the outlet. The rotary pistons are formed by two coaxial semi-cylinders having different radii with a ratio of 2.5 to 2.8 relative to each other. Transition surfaces are formed between the semi-cylinder with the large radius and the semi-cylinder with the small radius. These transition surfaces dovetail with the corresponding transition surfaces of the other rotary piston and together with the associated casing inner cylindrical surfaces. The side plates and the cylindrical surfaces of the semi-cylinder with the small radius form working chambers having variable volume therewith. The cylindrical surface of the semi-cylinder with the large radius terminates in an angle of 15° to 25° before a base plane or surface thereof with an angle of 30° to the axis of symmetry of the rotary piston in sides or flanks. The semi-cylinders with the large radius are made hollow and consist of light metal. The rotary pistons at the axial sides thereof have concentric disks which, with the peripheral surfaces thereof, operate with a close but contactless gap relationship in recesses in the walls of the side plates. The side of the semi-cylinder with the large radius upon the outer side thereof has recesses for balancing of the rotary pistons.

7 Claims, 6 Drawing Sheets

U.S. PATENT DOCUMENTS

| | | | |
|---|---|---|---|
| 2,193,273 | 3/1940 | Dietzel | 418/70 |
| 2,247,454 | 7/1941 | Thomson | 384/481 |
| 2,368,019 | 1/1945 | Guibert | 418/206 |
| 2,582,297 | 1/1952 | Thatcher | 62/402 |
| 2,633,807 | 4/1953 | Collura | 418/206 |
| 2,672,823 | 3/1954 | Thomson | 418/206 |
| 2,690,869 | 10/1954 | Brown | 418/113 |
| 3,126,834 | 3/1964 | Bursak | 418/206 |
| 3,396,667 | 8/1968 | Schmitt | 418/152 |
| 3,748,069 | 7/1973 | Persson | 418/191 |
| 3,863,609 | 2/1975 | Ikarashi | 418/191 |
| 3,865,524 | 2/1975 | Stauth | 418/206 |
| 3,969,940 | 7/1976 | Butcher | 418/191 |
| 4,368,013 | 1/1983 | Toogood | 418/206 |
| 4,464,102 | 8/1984 | Eiermann | 418/191 |
| 4,561,836 | 12/1985 | Wankel | 418/191 |

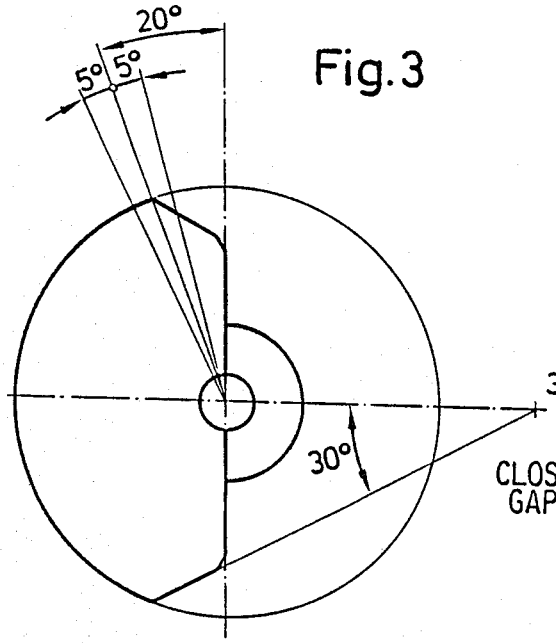
Fig.3
Fig.4
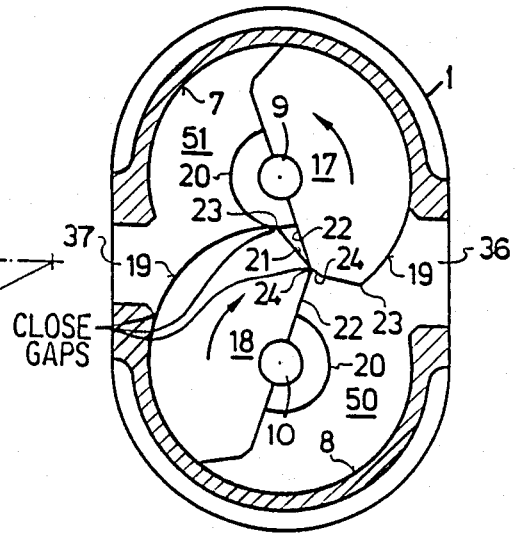
Fig.5
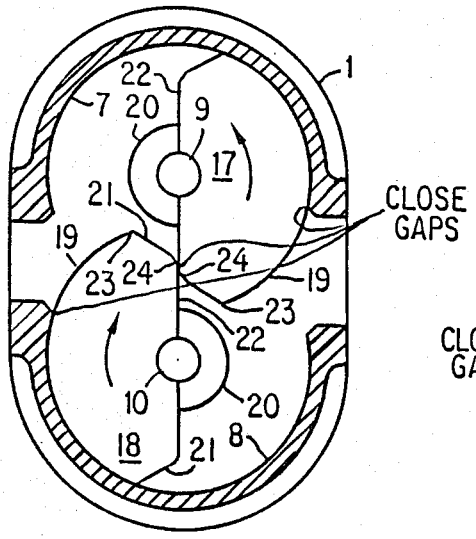
Fig.6
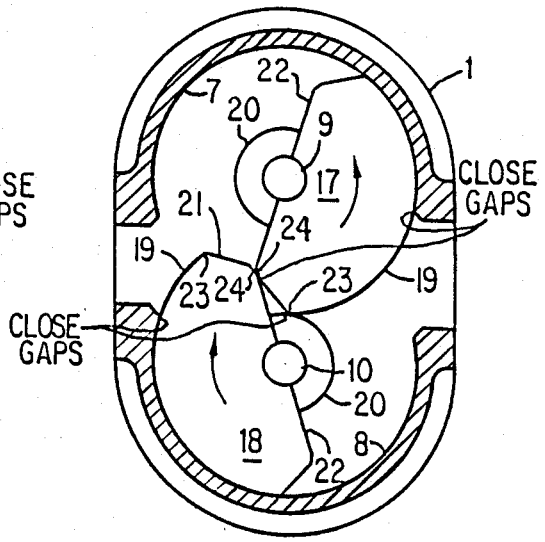

PARALLEL-AND EXTERNAL-AXIAL ROTARY PISTON BLOWER OPERATING IN MESHING ENGAGEMENT

This application is a continuation application of Ser. No. 667,952 filed Nov. 2, 1984, now abandoned.

The present invention relates to a parallel and external-axial rotary piston blower machine having a cocoon-shaped cross section with two arcuate segmental rotors operating in meshing engagement with inner cylindrical surfaces or internal curved surfaces of a machine casing or enclosed rotary piston blower housing. The rotary piston blower housing includes a casing in the form of housing plate elements or side plates having two cylindrical internal curved surfaces or inner cylindrical surfaces that intersect each other, being identical in shape reciprocally, as well as having an inlet and an outlet in the region of the intersections or meshing lines of these inner cylindrical surfaces or internal curved surfaces. The rotary piston blower housing also has two side plates or housing plate elements that have two shafts journaled thereby counter rotating with equal angular velocity coaxially relative to the internal curved surfaces or inner cylindrical surfaces located vertically thereof. Identically shaped rotary pistons on the shafts, mutually rigidly connected therewith, rotate thereon. The rotary pistons, each being formed by two coaxial semicylinders have different large and small radii. The semicylinders have base surfaces thereof against each other. The semicylinder with a large radius has the cylindrical surfaces thereof then beginning to run along the respective internal curved surfaces generally described as inner cylindrical surfaces and along the cylindrical surfaces of the semicylinders with the small radius of the other rotary piston, when coming out of engagement with the internal curved surface generally described as an inner cylindrical surface. Transition surfaces are formed thereby between the semicylinder with the large radius and the semicylinder with the small radius. These transition surfaces mesh or dovetail with the corresponding transition surfaces of the other rotary piston and together with the internal curved surface or inner cylindrical surface, the side parts and the cylindrical surfaces of the semicylinder with the small radius form operating or working chambers having variable volume therewith.

BACKGROUND OF THE INVENTION

1. Field of the Invention

Such machines can be compressors operating as pumps or as counter valves or blowers or superchargers operating only counter to a pressure chamber. These machines have the advantage that very long sealing paths exist between the rotary piston blower housing or casing and the semicylinder with the larger radius on the one hand and the end surfaces of the rotary piston on the other hand. Furthermore a linear, though sealing, limit or boundary is formed by surfaces running up tangentially against each other between cylindrical surfaces rolling-off and gliding against each other.

2. Description of the Prior Art

German Offenlegungsschrift 20 61 567 discloses an initially described machine functioning as a compressor operating counter to or against a rotary slide valve controlled via the synchronizing gear of the machine. The transitions from the cylindrical surfaces with large radius to the cylindrical surfaces with small radius are constructed as teeth surfaces or flanks of a tooth that engage relative to each other so that this machine operates like a gear pump with large gaps between teeth.

This machine must be very well sealed-off in order to reach the desired sealing effects, resulting from the compression ratios represented in the drawings. The machine accordingly must start up with an oil film directly on the cylinder wall of the housing and the side walls thereof and likewise the cylinder surfaces of the rotary pistons must roll off directly with a sufficient oil film because of the sliding engagement therewith. The teeth surfaces or flanks of a tooth of the transitions between the cylinder surfaces also must slide off connected or force-looking against each other. Consequently, very large frictional resistances must be overcome and the machine cannot run or operate free of oil or with higher speeds. The working or operating gas must be conveyed at the inlet and the outlet around an edge generating a very acute-angular turbulence or whirl between the inlet passage and the cylindrical housing wall, whereby the part of the one piston having the large radius lies respectively before the inlet and the outlet and the flow path is considerably narrowed or restricted thereby. Furthermore, compressive flows consuming capacity to a high extent as known for geared pumps, as well as gas enclosures being intensely or strongly compressed, result during engagement of the transition surfaces between each other, so that this machine is very unfavorable as to flow technology. Also, the operation counter to, or compared with, a valve results in an intermittent flow discharge causing strong or intense noises. The flow discharge additionally produces or generates longitudinal waves in the pressure line or conduit; such waves, for instance, would preclude the employment thereof as a charger for multi-cylinder combustion engines. Finally, such machines can supply no oil-free working or operating gas, since these machines must run with an oil film because of the direct advance of the moved parts thereof, which, in any case, considerably restricts or limits the possibilities of employment and utilization thereof.

SUMMARY OF THE INVENTION

An object of the present invention is to develop or evolve a machine of the aforementioned type as a blower or supercharger machine to be produced very simply and with very little cost. The machine has a high delivery rate with small structural size and with small or nominal drive capacity, as much as possible noiseless, silenced or low as to noise and quiet in operation and producing no disturbing pressure pulsations. The machine accordingly is well adapted and suited for the loading or charging of multi-cylinder internal combustion engines, for exhaust gas blowers or superchargers or as conveying blowers or superchargers for technical purposes.

These conditions or requirements could not be met or fulfilled previously, thus being satisfied only very inadequately by the previously known blowers or superchargers. The present inventive blower or supercharger machine fulfills such conditions or requirements in a surprising manner in the entirety thereof on the basis of structural features described in the following disclosure.

BRIEF DESCRIPTION OF THE DRAWINGS

This object, and other objects and advantages of the present invention, will appear more clearly from the following specification in connection with the accompanying drawings, in which:

FIG. 3 is an illustration of the angle measurements decisive or crucial for the present invention;

FIGS. 4, 5, 6, 7, 8 and 9 schematically show position illustrations for the blower or supercharger machine having features according to FIGS. 1 and 2;

DETAILED DESCRIPTION OF PREFERRED EMBODIMENTS

Figure 2:
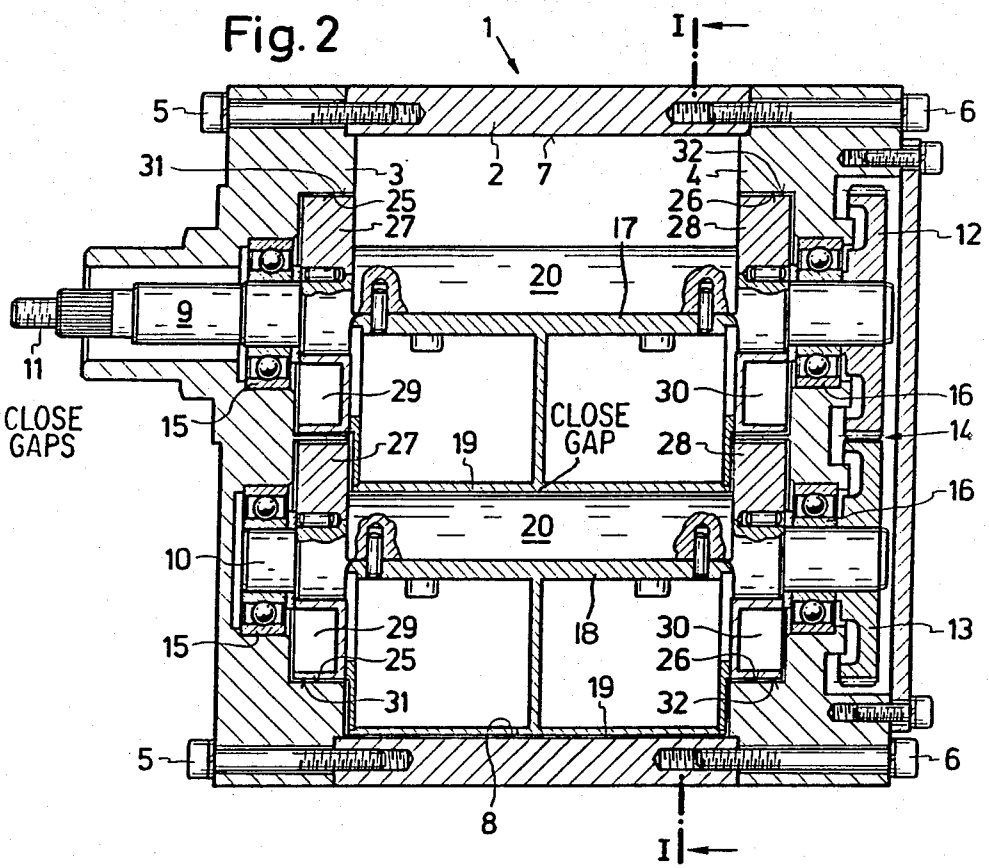
FIG. 2 is an axial cross sectional view through the same blower or supercharger machine as taken along II—II in FIG. 1.
Figure 1:
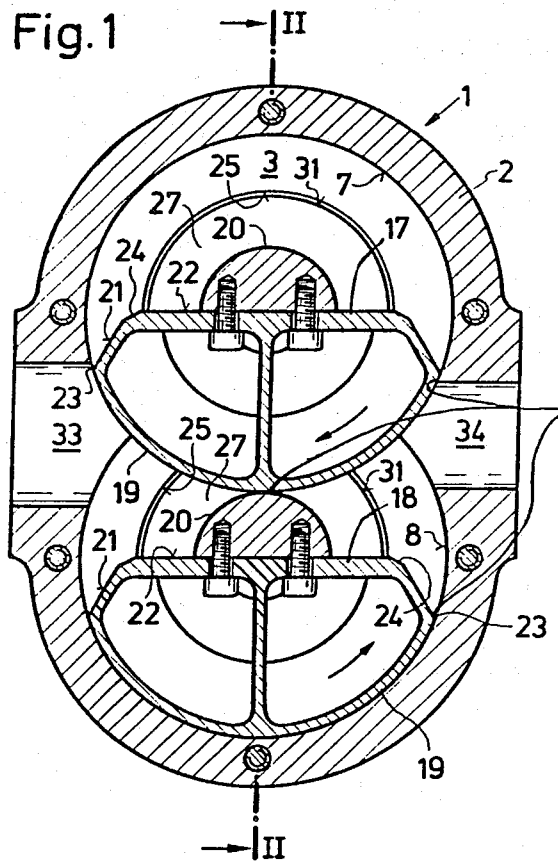
FIG. 1 is a radial cross sectional view through a blower or supercharger machine in accordance with the present invention as taken along line I—I in FIG. 2.

Referring now to the drawings in detail, the blower or supercharger machine illustrated in FIGS. 1 and 2 has a machine casing or enclosed housing 1, which consists of a casing part 2, a left side part 3 and a right side part 4, which parts are connected with each other by screws 5 and 6. The casing part 2 has parallel and equally large cylindrical internal curved surfaces or inner cylindrical surfaces 7 and 8 intersecting relative to each other. The side plates or housing plate elements 3 and 4 are vertical and two shafts 9 and 10 pass or extend therethrough coaxially of the cylindrical internal curved surfaces or inner cylindrical surfaces 7 and 8. The upper shaft 9 in FIG. 1 has a driver or drive journal 11. The two shafts 9 and 10 are connected frictionally by a synchronous transmission 14 consisting of two identical gears 12 and 13 located in the right side plate or housing plate element 4, so that the gears rotate oppositely during propulsion via the driver or drive journal 11. The two shafts 9 and 10 are mounted or journaled in ball bearings 15 and 16 in the side plates or housing plate elements 3 and 4. Two rotary pistons, indicated generally by arrows 17 and 18, are rigidly rotated with these shafts and revolve on the shafts 9 and 10; the rotary pistons 17 and 18, as represented generally, include a semicylinder 19 with a large radius coaxial to the respective shaft 9 or 10 and a semicylinder 20 with a small radius coaxial to the same shaft. The large radius is smaller by a nominal gap measurement than the radius of the semicylindrical internal curved surfaces 7 and 8. The small radius is smaller by 2.5 times than the large radius.

The cylindrical peripheral area of the semicylinder 19 with the large radius discontinues at 15° to 25°, preferably 20° angle of rotation to the base plane of the semicylinder thereof in flanks or transition surfaces 21 with an edge angle of 30° to the plane of symmetry of the rotary piston 17, 18 (FIG. 3). The peripheral area of the semicylinder 19, accordingly with the exemplified embodiment illustrated in FIGS. 1 and 2, extends only over 140° angle of rotation.

These flanks or transition surfaces 21 and the base surfaces 22 of the semicylinder 19 with the large radius between the cutting edges with the flank 21 and the onset or beginning edge of the semicylinder 20 with the small radius form the mating surfaces of the rotary pistons 17 and 18 during the rotation thereof between the phases of mutual rolling-off respectively of the semicylinder 19 with the large radius and of the semicylinder 20 with the small radius of the other rotary piston 17 or 18. The radii of the semicylinders are so measured or apportioned, that these radii permit the outer corners or edges 23 and the rounded-off portions, inner corners or edges 24 of the flanks or transition surfaces 21 cooperate with only a narrow or close gap therebetween and these corners or edges themselves pass along the base surfaces 22 of the other rotary piston without engagement. The corners 24 are curved or rounded-off arcuately for forming a circular arch in order to avoid a direct engagement therewith.

Each base surface 22 is a portion of the piston of greater radius and has a distance greater than twice the small radius and smaller than twice the large radius that extends from an axis of a shaft toward an inner cylindrical surface of the casing, and the transition surfaces 21 on each of the pistons are formed between the base surface 22 and the arc of greater radius; the transition surfaces begin at the outer location of the base surfaces 22 that extend and are disposed to cooperate with corresponding transition surfaces of the other piston in a seal close gap relationship, for example, illustrated progressively by FIGS. 4–8 inclusive.

The position of the two rotary pistons 17 and 18 is always such that, in each of the phases of movement thereof, symmetrical relationship exists with respect to each other and relative to the housing.

The semicylinders 20 with the small radius are made unitary or in one piece with the shafts 9 and 10 thereof so that these semicylinders 20, in the region of the axial length of the rotary pistons 17 and 18, have a semicircular shaped cross section, in the planar surface of which there lies the shaft middle or central axis. The semicylinders 19 with the large radius contrary to the semicylinders 20 with the smaller radius consisting of massive or solid steel are made of hollow-drawn or extruded aluminum for the purpose of balancing and are rigidly connected with the shaft 9 or 10 by screws.

The shafts 9 and 10 axially adjacent to the rotary pistons 17 and 18 have disks 27 and 28 running in the recesses 25 and 26 located or provided in the housing side walls, plates or plate elements; the disks 27 and 28, in the sides thereof away or remote from the rotary pistons 17 and 18, have recesses 29 and 30, which serve for further balancing of the rotary pistons. These disks 27 and 28 with the peripheral areas or surfaces 31 and 32 thereof pass along relative to the recesses 25 and 26 with most narrow gap relationship remaining therebetween, while after the end faces of these disks there is permissible a greater play or clearance with respect to the end faces of the recesses 25 and 26. The sealing of the end faces of the rotary pistons is problematical because of the bearing play or clearance; however, via this feature, the sealing of the end faces of the rotary pistons is shifted or relocated in the gap between the peripheral surfaces or areas 31 and 32 and the recesses 25 and 26; this gap can be produced with the required accuracy without difficulty. The rotary pistons movable in the casing operate along the walls of the side plate and conform to complement each other continuously having the close gap relationship therewith.

Rotational balancing means encompass such an annular disk (27,28 respectively 64,65) attached for rotation with each of said pistons, an annular recess 25,26 is formed in the casing 1,3,4 and attached to receive the annular disks 27,28; the annular disk provides rotational balance attained by removal of recessed or hollow portions 29,30 at appropriate locations thereon; the gaps between the adjacent peripheral 31,32 and side surfaces of the disks 27,28 and the recess 25,26 at the same time provide an additional function of tortuous gap seals for the fluid.

As to the meaning of "tortuous gap seals", there is meant the sealing gap relationship between the parts 27 respectively 28 (left and right disks) and the adjoining side parts 3 and 4 in FIG. 2. These disks run in the recesses 25 and 26 in the side parts 3 and 4 with narrow play; while the gap between the base of these recesses 25 and 26 and the end of the faces of the disks 27 and 28 can have a greater play, being held wider, the base of the recesses 25 and 26 being located in a vertical or upright plane in the drawing. The purpose of this arrangement is that the last-mentioned wider gap between the recess base and the face side of the disk cannot be permitted to be too narrow because of the axial oscillations or vibrations of the rotating rotary piston. The seal consequently is displaced from occurrence in the adjacent axial direction into occurrence in the radial location, accordingly into the ring gap near the reference numeral 25 in FIG. 2. This can be very narrow with the exact or accurately journaled shaft and most of all can be produced by simple or straightforward turning-out and turning-off with corresponding tolerances in a satisfactory fabrication thereof.

"Tortuous" gap refers to the gap in narrowest possible space relationship existing for example, between the end face of the disk and the recess base included in the sealing path and considered to be in a sense a "labyrinth seal". Thus, the "narrowest gap" must be taken literally as to the meaning thereof to represent the tightest or closest relationship of the parts relative to each other ("tortuous" means "full of twists and turns" literally per dictionary).

There has been shown and proven in practice that a completely sufficient or adequate sealing-off can be attained herewith. Most of all, the suctioning of oil from the space or chamber of the synchronous transmission 14 into the operating or working spaces or chambers can be precluded as a consequence of the pressure pulsations arising therein. The housing in itself running dry, thus, can deliver pressure medium completely free of oil.

Inlet 33 has a width in radial section compared with the outlet 34 such that the width of the inlet 33 is larger by approximately 1.35 times for improvement of the flow conditions or relationships. In the exemplified embodiment illustrated in FIG. 10, there is a trough or depression 35 continuously over the entire length of the rotary piston 17 or 18 arranged in the base plane or surface 22 for improvement of the flow guidance or conveyance during passage of the outer corner 23 of the flank 21.

Figure 11:
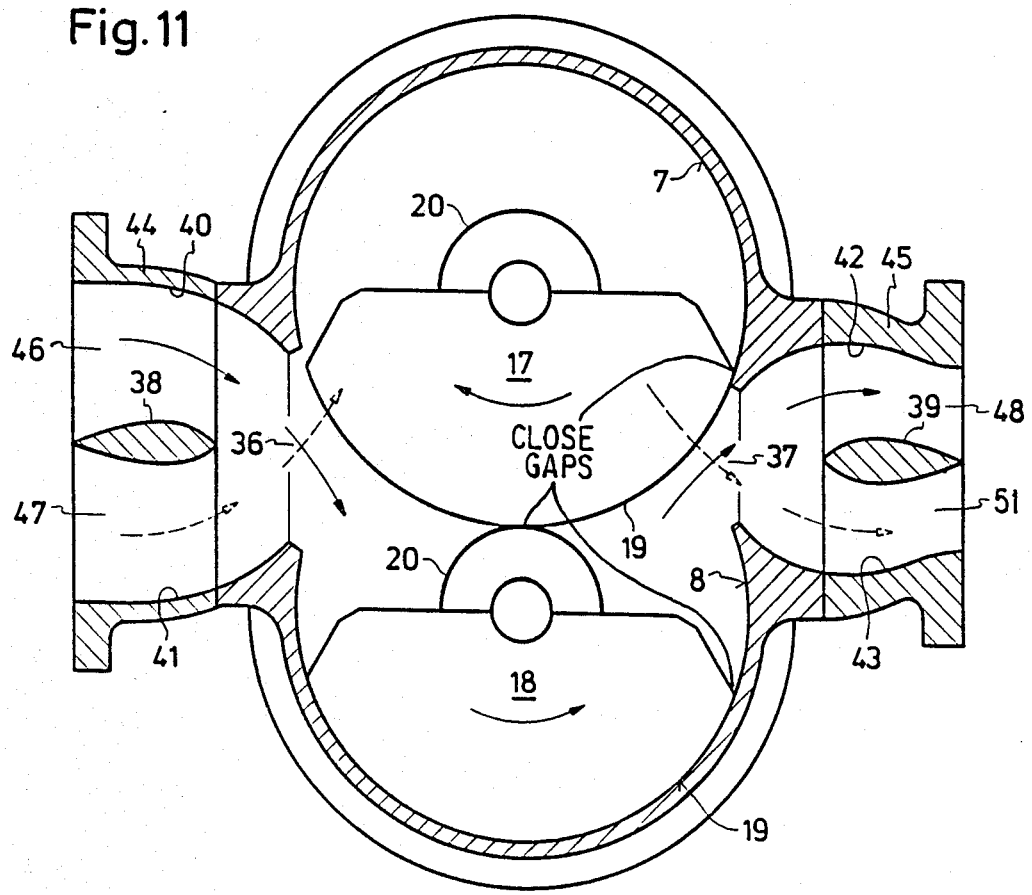
FIG. 11 illustrates a blower or supercharger machine for FIGS. 1 and 2 with an improved construction of the inlet and outer connections.

In a further specific embodiment according to FIG. 11, an inlet 36 and an outlet 37 are shown before which bodies 38 and 39 are arranged for the flow guidance or conveying. These bodies 38 and 39 extend with identical cross section over the entire axial length of the inlet 36 and outlet 37. These bodies 38 and 39 together with the curved or bent walls 40 and 41 of the inlet connection 44 or the curved or bent walls 42 and 43 of the outlet connection 45 form the two inlet passages or channels 46 and 47 for the two outlet passages or channels 48 and 49, which reroute or divert the flow in a more tangential direction to the casing inner cylindrical surfaces or internal curved surfaces respectively released or cleared by the rotary piston.

Figure 12:
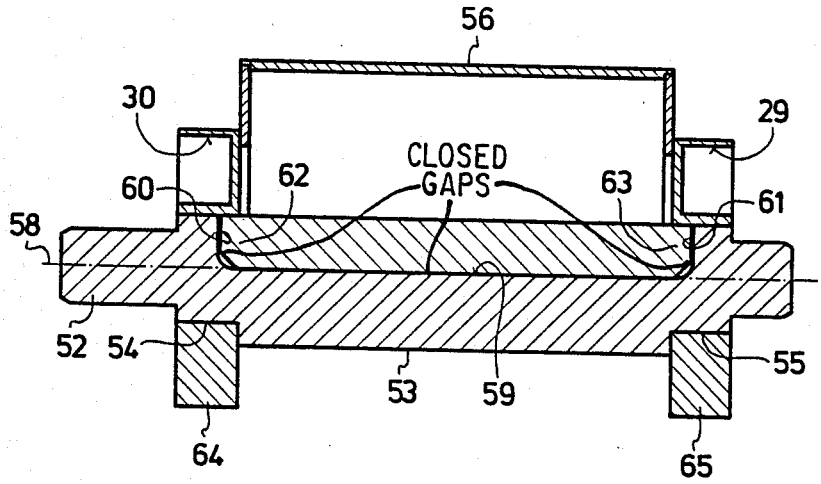
FIG. 12 is an axial cross sectional view through a further structural embodiment of a rotary piston for the blower or supercharger machine of FIGS. 1 and 2.

FIG. 12 represents a single rotary piston (the second rotary piston is entirely the same), as corresponding to the rotary piston 17 respectively 18 in FIG. 2 and the rotary piston of FIG. 12 is shown in the same axial section or position.

Figure 13:
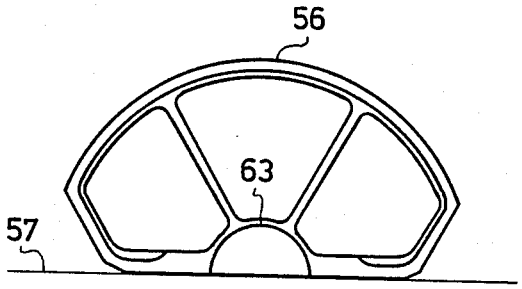
FIG. 13 is a partial radial cross sectional view for the structural embodiment of FIG. 12.

In FIG. 12 there is illustrated a specific embodiment of the rotary pistons 17 and 18 intended for a simple fabrication, production or manufacture. The shaft 52 is produced unitary or in one piece together with the semicylinder 53 with a small radius, whereby the semicylinder 53, first together with the shaft 52 together with the shoulders 54 and 55 provided on both sides of the semicylinder, is turned-out fully round or machined into the shape of a recess 59 as far as to the plane of the center axis of the shafts which recess 59 extends as far as into the shoulders. The recess 59 of the semicylinder with large radius is formed of one hollow body of aluminum which has semi-round extension, on opposite sides therein with radius like that of the shoulders being formed therein. For the insertion of the semicylinder 56 with large radius of aluminum illustrated in a radial section in FIG. 13, there is milled-out or reamed the semicylinder 53 with a small radius as far as to a plane 57, in which the shaft axis 58 lies, in a recess 59, which recess 59 extends or mates at 60 and 61 into he shoulders 54 and 55. That part forming the semicylinder 56 with the large radius on the one hand has semicircular or half-round extensions 62 and 63 with the same radius as that forming the shoulders 54 and 55, which extend as far as to the ends of the recesses at 60 and 61 in FIG. 12. After insertion of the part forming the semicylinder 56 with the large radius, then the disks 64 and 65 with a fitting bore are pushed over the shoulders 54 and 55 and the extensions 62 and 63, which thereby are held together securely, without requiring any screws or union. The disks 64 and 65 for example can be shrunk-on and friction-welded. The disks 64 and 65 correspond to the disks 27 and 28 and have the recesses 29 and 30.

The following can be noted as to how disks 64 and 65 are accommodated over shoulders 54 and 55 and extensions 62 and 63 as well as what is meant when referring to a fitting bore. The disks 64 and 65, correspond to the aforementioned disks 27 and 28 in FIG. 2 and have the aforementioned function of sealing-off and simultaneously the function of balancing as counterweights, such disks 64 and 65 having a central bore therewith. The disks 64 and 65 are moved over the "shoulder" 54 respectively 55 of the shaft which supports the semi-cylinder 53 with small radius, whereby the fit is so narrow or close that further fixation for accuracy is not required (for example, via shrinking or pressure-welding). The disks 64 and 65 touch over the extensions 62 and 63 of the semi-cylinder 65 with a large radius, which is installed in a recess 59 of the semi-cylinder 53 with a small radius. Accordingly, in FIG. 12 there is illustrated a simplified construction of the blower according to FIG. 1 which does not require any screw or bolt connection.

Referring now to the illustrations of FIGS. 4 through 9 inclusive, the upper rotary piston 17 in FIG. 4 carries out an induction or intake stroke by opening and expanding of the upper working or operating chamber 49, while the lower rotary piston 18 exhausts the gas suctioned thereby in the lower working or operating chamber 50. The inlet 36 is separated from the outlet 37 by the two rotary pistons 17 and 18, whereby split or divided chambers or spaces located and formed collectively between the internal curved surfaces or inner cylindrical surfaces 7 and 8 and the peripheral beginning areas or surfaces of the semicylinder 19 with a large radius are very long and thus practically being fully tight or sealed with the given pressure differences of a blower or supercharger machine; and the leakage path is sufficiently sealed-off likewise for blower or supercharger pressures between the two rotary pistons via the tangential beginning surfaces of the semicylinder 20 with the small radius of the upper rotary piston 17 and of the semicylinder 19 with the large radius of the lower rotary piston 18 as well as through the split space or chamber formed by the base plane or surface 22 of the rotary piston 17 and the flank 21 of the lower rotary piston 18.

Figure 7:
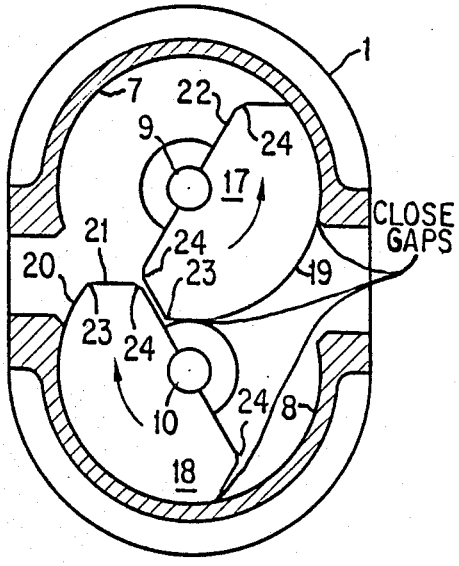
Figure 8:
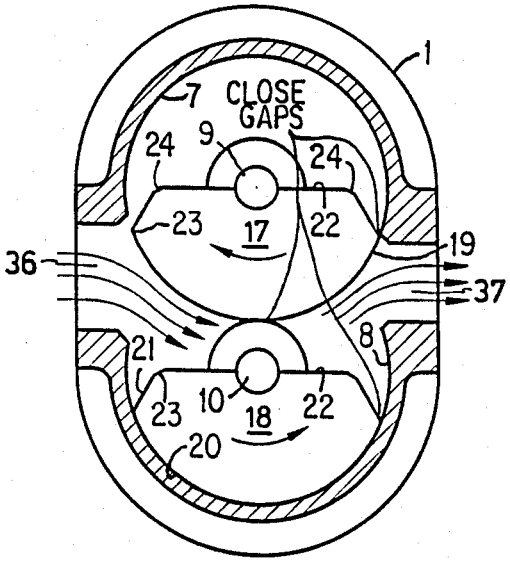
Figure 9:
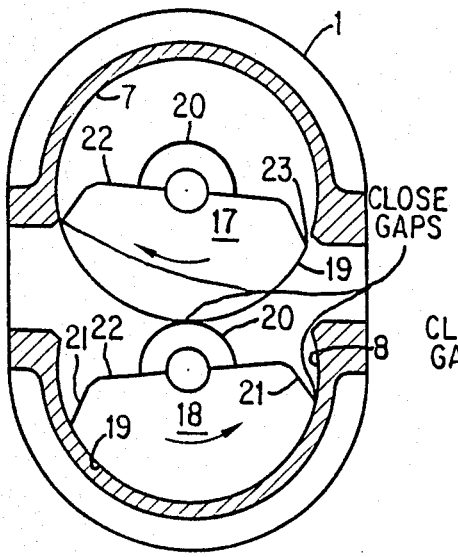
Figure 14A:
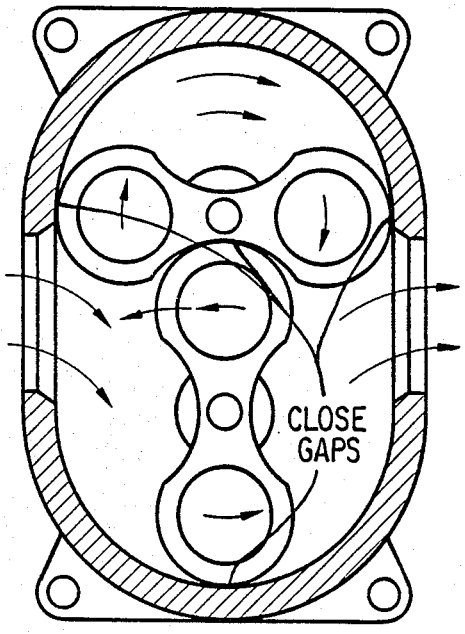
Fig. 14A (PRIOR ART)
FIGS. 14A and 14B are two comparatively illustrated radial cross sections through a Roots blower or supercharger machine.
Figure 14B:
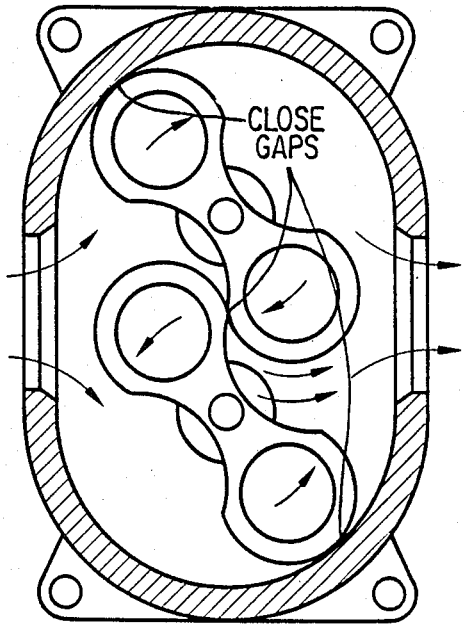
Fig. 14B (PRIOR ART)

This sealing or tightness, as represented in FIGS. 5 and 6, is maintained between the rotary pistons 17 and 18 by mutual rolling-off of the inner corner 24 of the flanks 21 on both sides, until in FIG. 7 again the sealing or tightness occurs between the semicylinders on both sides, now the larger 19 of the lower rotary piston 18 along the smaller 20 of the upper rotary piston 17. The lower working or operating chamber 51 in FIGS. 8 and 9 is exhausted, while the working or operating chamber 50 is closed-off by the upper rotary piston 17 with respect to the inlet 36, whereupon the exhaust thereof begins as illustrated in FIG. 9; simultaneously the lower rotary piston 18 again opens the working or operating chamber 50 after the inlet 36 for the next induction or intake stroke. Inlet and outlet in all of these phases of movement are completely separated. It is, however, a special feature or advantage of this machine, that relationship involving the inlet-flow and the outlet-flow of the working gas proceeds in a continuous and never interrupted manner; rather, uniquely as shown by FIGS. 7 and 8, the suction stroke or intake in the operating or working chamber 50 has a continuous and never interrupted relationship including an interval in a transition into the suction stroke or intake into the operating or working chamber 51; and likewise, the exhaust from the operating or working chamber 51 has a continuous and never interrupted relationship including an interval in a transition into the exhaust from the operating or working chamber 50 so that in this way the inlet and outlet flow of the working gas is undisturbed, uniform continuous and uninterrupted. The suctioning or inducting rotary piston during withdrawal through the other rotary piston continually clears the line or frees the path from the pressure chamber to the outlet and the corresponding relationship exists on the inlet or induction side. The flanks 21 and the base planes 22 thereby always move in the flow direction of the working or operating gas. This is a very essential and considerable improvement compared with the Roots blower or supercharger machine employed for the same purposes with which the very considerable inlet- and outlet-noises arise thereby that the rotary pistons move counter to the direction of the inlet- and outlet-flow of the working or operating has as shown by FIG. 14. Via this movement of the piston-front in the direction of the flow and through the transition of the induction or exhaust from the upper side to the lower side and the complete exposure of the suctioning or induction path or exhaust path, there is attained an unusually quiet and low-noise running or operation. This effect is still further considerably improved by the arrangement of inlet-and outlet-connections 44 and 45 according to FIG. 11. By expansion or widening of the inlet passage or channel 36 there results a further improvement of the flow conditions or relationships, with which the turbulence or eddying is avoided extensively by the edges between the inlet passage and the casing inner cylindrical surface or internal curved surface.

Figure 10:
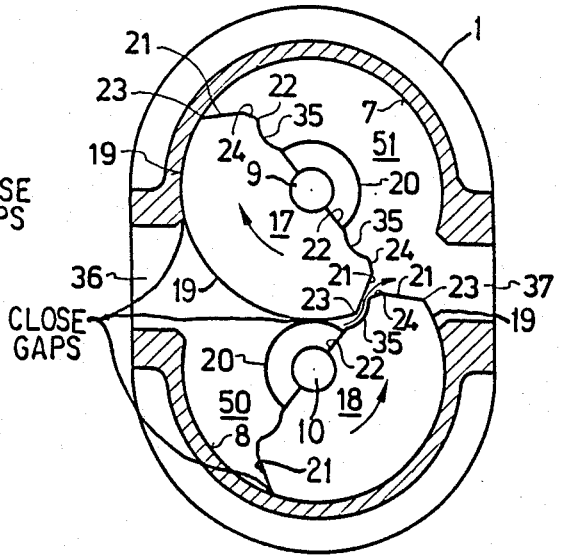
FIG. 10 illustrates a further constructive development of the blower or supercharger machine for FIGS. 1 and 2.

With respect to FIG. 10, there is noted that in order to avoid compressive flows and enclosures of the operating gas in the meshing or mating region, which means during interengagement of flanks 21 and base plane 22, the rounding-off of the edges or corners 24 has been provided between the two planes or surfaces and the depression 35. During the movement of the two rotary pistons 17 and 18 into the position which is shown in FIG. 4, in which the flank 21 of the lower rotary piston 18 moves against the base plane or surface 22 of the upper rotary piston 17 and likewise in the movement toward the position shown in FIG. 10, in which the flank 21 of the upper rotary piston 17 moves against or counter to the base plane or surface 22 of the lower rotary piston 18, the gas would be enclosed; such gas can discharge through the trough or depression 35 in the position of the outlet opening according to FIG. 4 and in the position according to FIG. 10 discharging into the working or operating chamber 49 found or located in the induction or intake stroke. Furthermore, a direct running-on or striking of the outer corner 23 of the flank 21 against the base plane or surface 22 is avoided by this trough or depression 35. In contrast to all other known machine casing or enclosed rotary piston housing means of blowers or superchargers, the present inventive blower or supercharger machine has a very low-noise quiet running or operation. In relation to the structural size and to the cost as to drive capacity, there is provided a conveying capacity that is very high and proportional to the speed. This means there results already at low speeds a good conveying capacity which rises proportional as far as to the speeds of a magnitude of 6,000 revolutions per minute and also then not decreasing or dropping in value.

A further advantage of the present inventive blower or supercharger machine is that the parts coming into association with the operating or working gas run completely without lubrication, so that the operating or working gas remains oil-free, especially also thereby that no transmission oil can come into or enter the working or operating chambers. The blower or supercharger machine accordingly can be employed for such purposes which require an oil-free conveying flow free of any concern or worry. Finally, the blower or supercharger machine can be employed advantageously for charging or supercharging of motors or engines, since it produces and generates an essentially uniform conveying flow; consequently, a synchronization or adaptation and matching to the cycles or strokes of the individual cylinders of the motor or engine to be charged or supercharged is unnecessary.

Finally, an advantage of the present inventive construction is that all structural parts (with the exception of the inlet- and outlet-connections according to FIG.

11, which can be casting parts) have only circular or even surfaces or planes; this was not to be expected with a machine or an engine having such advantageous flow conditions or relationships so that an inexpensive fabrication or manufacture thereof is made possible.

The present invention is, of course, in no way restricted to the specific disclosure of the specification and drawings, but also encompasses any modifications within the scope of the appended claims.

What I claim is:

1. In an external parallel axis rotary piston blower working in mating engagement, having improvements in combination therewith comprising:

a casing having two inner cylindrical surfaces that intersect each other, an inlet and an outlet in a region of the intersections of these inner cylindrical surfaces such that inlet and outlet flow of a working gas is undisturbed and uniform without being turbulent therein, two side plates and two shafts vertically thereof counter-rotating with equal velocity;

identically shaped rotary pistons on said shafts respectively rigidly connected therewith, said rotary pistons each being formed by two coaxial semi-cylinders having different radii including a semi-cylinder of larger radius and a semi-cylinder of small radius, of which the semi-cylinder with the large radius also has a portion with a plane having a length greater than twice the small radius and smaller than twice the larger radius that extending from the axis of the shaft toward the inner cylindrical surface of the casing and has a portion with outer large radius cylindrical surfaces thereof that move progressively along the respective casing inner cylindrical surfaces and also move progressively along the cylindrical surfaces of the semi-cylinders with the small radius of the other rotary piston, respectively; and transition surfaces on each of said rotary pistons formed on the semi-cylinder with a large radius; said transition surfaces being disposed at an angular offset direction relative to and beginning at corners of said transition surfaces that cooperate with the corresponding transition surfaces of the other rotary piston and that collectively with the casing inner cylindrical surface, the side plates and the cylindrical surfaces of the semi-cylindrical with the small radius form working chambers to allow variable volume therewith accompanied by the flow of the working gas that is undisturbed and uniform without being turbulent via slanting of the piston through outer mating surfaces including said transition surfaces disposed at the angular offset direction, the rotary pistons at axial sides thereof have disks, which with peripheral surfaces thereof operate with a seal radially between said disks and recesses in the wall of the side plates having a close gap relationship free of contact in a region of the casing and disks where heat expansion is identical and consequently negligible, said semi-cylinder with the large radius having recesses therein for balancing of the rotary pistons relative to each other.

2. A rotary piston blower in combination according to claim 1, in which the radii of said semi-cylinders have a ratio of 2.5 to 2.8 with respect to each other.

3. A rotary piston blower in combination according to claim 1, in which each of the pistons has a plane of symmetry of rotary piston sides such that the cylindrical surface of the semi-cylinder with the large radius terminates in said angular offset direction at an angle of 15° to 25° relative to a base surface of said large-radius semi-cylinder and in a direction with an angle of 30° relative to the plane of symmetry of the rotary piston sides thereof.

4. A rotary piston blower in combination according to claim 3, in which each semi-cylinder has flanks including axial sides therewith and a base surface therewith as well as a corner between said flanks and said base surface, said corner being rounded along an external radius unit with which the mating surfaces roll off relative to each other.

5. A rotary piston blower in combination according to claim 3, in which edge locations of the semi-cylindrical surface of the semi-cylinder with the small radius exist that coincide in the mating engagement for a transitional relationship in corresponding position relative to the base surface of the semi-cylinder with the large radius relative to each other.

6. A rotary piston blower in combination according to claim 1, in which shafts of the rotary pistons are unitary with the semi-cylinder with the small radius and project laterally therefrom relative to recessing complementary thereto in said casing.

7. A rotary piston blower in combination according to claim 6, in which the rotary pistons movable in the casing operate along the walls of the side plate and conform to complement the rotary pistons relative to the side plate respectively laterally as to each other continuously having the close gap relationship therewith.

* * * * *